US007201532B2

(12) United States Patent
Konno

(10) Patent No.: US 7,201,532 B2
(45) Date of Patent: Apr. 10, 2007

(54) METHOD AND DEVICE FOR ADJUSTING HEIGHT OF MANHOLE

(76) Inventor: Shuichi Konno, 57-3, Chu 1-chome, Musashimurayama-shi, Tokyo, 208-0003 (JP)

( * ) Notice: Subject to any disclaimer, the term of this patent is extended or adjusted under 35 U.S.C. 154(b) by 0 days.

(21) Appl. No.: 10/467,852

(22) PCT Filed: Feb. 4, 2002

(86) PCT No.: PCT/JP02/00896

§ 371 (c)(1),
(2), (4) Date: Feb. 2, 2004

(87) PCT Pub. No.: WO02/064894

PCT Pub. Date: Aug. 22, 2002

(65) Prior Publication Data

US 2004/0109727 A1 Jun. 10, 2004

(30) Foreign Application Priority Data

Feb. 13, 2001 (JP) ..... 2001-035941
Feb. 1, 2002 (JP) ..... 2002-026035

(51) Int. Cl.
*E01D 29/14* (2006.01)

(52) U.S. Cl. ..... 404/25; 404/26; 52/19; 52/20

(58) Field of Classification Search ..... 404/25, 404/26; 52/19, 20; 254/131
See application file for complete search history.

(56) References Cited

U.S. PATENT DOCUMENTS 3,401,973 A * 9/1968 Marshall ..... 294/93
3,847,339 A * 11/1974 Farrell ..... 249/1
4,681,300 A * 7/1987 Drugge ..... 254/131
5,035,336 A * 7/1991 Schmitz et al. ..... 212/166
5,382,131 A * 1/1995 Werthmann ..... 414/684.3
5,458,435 A * 10/1995 Kohno ..... 404/25
5,462,385 A * 10/1995 Mohlengraft ..... 404/25
5,476,300 A * 12/1995 Dodge ..... 294/81.21
5,660,422 A * 8/1997 Knisley ..... 294/67.33
5,674,045 A * 10/1997 Eckloff et al. ..... 414/684.3
5,947,633 A * 9/1999 Foss ..... 404/25
5,993,106 A * 11/1999 Huang ..... 404/26
6,161,985 A * 12/2000 Hinkle et al. ..... 404/26
6,196,760 B1 * 3/2001 Sinclair ..... 404/26

* cited by examiner

*Primary Examiner*—Raymond Addie
(74) *Attorney, Agent, or Firm*—Apex Juris, pllc; Tracy M. Heims

(57) ABSTRACT

A method and a device for safely and efficiently adjusting the height of a manhole freely allowing the addition and removal of a height adjusting member at any position. The method and device may be used for the manhole formed by installing a tubular shaped frame in the ground, installing the removable height adjustment members on the tubular shaped frame, and installing a cover receiving frame on the height adjusting members. In this method and device, a frame is disposed in the upper space of the manhole; the cover receiving frame is raised by the height adjusting member installed on the frame; and the height adjusting members positioned under the cover receiving frame in that state are added or removed.

5 Claims, 18 Drawing Sheets

METHOD AND DEVICE FOR ADJUSTING HEIGHT OF MANHOLE

FIELD OF THE INVENTION

This invention relates to a method and a device for adjusting the level or height of a manhole.

DESCRIPTION OF THE PRIOR ART

A front surface of a manhole is supposed to be adjusted and leveled to become the same height as the road surface, thereby together forming a continuous, even surface.

However, as time goes by and after using the road for a long period of time, the road surface subsides leaving the manhole in its initial position, being exposed unnaturally.

If the road surface is raised, or the manhole subsides, the front surface of the manhole also subsides which may cause a traffic accident.

As a solution to the above-types of problems, adjustable height manholes have been developed.

As one example of the conventional art shown in FIG. 17, a manhole comprises a tubular shaped frame "a" positioned underground, an upwardly detachable height adjustment member "b" mounted on the tubular shaped frame "a", and a cover receiving frame "c" mounted on the height adjustment member "b". The cover receiving frame "c" has plural bolt holes formed therein.

An adjustment of the manhole height may be performed by driving a force bolt "d" into each bolt hole in the cover receiving frame "c" to press the bottom surface of the bolt shaft against the top surface of the height adjustment member "b".

Then, each force bolt "d" is further rotated to elevate the cover receiving frame "c" with a reaction force generated therein. After elevating the cover receiving frame "c" to a certain degree, the height adjustment member "b" is either removed if the road surface subsides or added if the rode surface elevates, thereby adjusting the manhole height to the same height as the road surface.

Problems to be Resolved by the Invention

A height adjustment process in the conventional manhole has the following points to be improved:

1. In the conventional manhole, the force bolt "d" is rotated to elevate the cover receiving frame "c" against the reaction force on the height adjusting member "b", and while the height adjustment member "b" is being removed or added, reaction force is being generated between the bottom surface of the shaft of the force bolt "d" and the top surface of the height adjustment member "b".

Accordingly, the height adjustment member "B", is positioned to face the bottom surface of the force bolt "d" and bears the force created therebetween, as shown in FIG. 18, and is designed to be the un-removable height adjustment member "B".

2. Therefore, the height adjusting member "b" could be a ring-shaped piece or a unit composed of individual, separate arc-shaped pieces. The conventional method includes a process of removing or adding arc-shaped height adjustment members "b" while the reaction force of the force bolt "d" is being generated against some of the individual, separate, height adjustment members "b" that bear the reaction force.

The reaction force of the force bolt "d" is applied in sequence against each un-removable height adjustment member "b" to change the height thereof, ultimately changing the height of the entire manhole.

3. A method for adjusting the height of the conventional manhole as described here is such that the arc-shaped height adjustment member underneath the force bolt "d" is always the un-removable adjustment member "B" which cannot be touched and therefore other height adjustment members "b" need to be added or removed while the height of the force bolt "d" is being changed.
4. Because the un-removable height adjustment member "B" acts as an obstacle, height adjustment members "b" cannot be inserted or deleted, and therefore other height adjustment members "b" need to be added or deleted while the height of the force bolt "d" is being changed.

Object of the Invention

This invention was made to improve the above described conventional manhole. For that purpose, an object of this invention is to provide a safe, efficient and improved manhole which offers a flexible height adjusting mechanism with the ability to add or remove height adjustment members at any height and a method for adjusting the manhole height with the same advantages.

This invention is a method for adjusting a manhole height comprising the steps of: positioning a tubular shaped frame underground; placing a removable height adjusting member on the tubular shaped frame and mounting a cover receiving frame thereon; positioning a base frame in a space at an upper section of said manhole; lifting the cover receiving frame by a drawing pole installed in the base frame; and removing said height adjusting member placed under the cover receiving frame or adding said height adjusting member under the cover receiving frame.

This invention further is a device for adjusting a manhole height comprising: a tubular shaped frame positioned underground; a removable height adjusting member placed on the tubular shaped frame; a cover receiving frame mounted thereon; a base frame positioned in a space at an upper section of the manhole; and a drawing pole installed in the base frame.

This invention further is a method for adjusting a manhole height comprising the steps of: positioning a tubular shaped frame underground; placing a removable height adjusting member on the tubular shaped frame and mounting a cover receiving frame thereon; positioning a base frame in a space at an upper section of the manhole; arranging a pushing member between the base frame and a road surface; connecting the base frame and the cover receiving frame by the drawing pole; raising the cover receiving frame via the drawing pole by means of the pushing member pushing the base frame up; forming a space underneath the cover receiving frame; and removing the height adjusting member located under the cover receiving frame or adding the height adjusting member under the cover receiving frame.

This invention further is a device for adjusting a manhole height comprising a tubular shaped frame positioned underground; a removable height adjusting member placed on the tubular shaped frame; a cover receiving frame mounted thereon; a base frame positioned in a space at an upper section of the manhole; a pushing member arranged between the base frame and a road surface; a drawing pole installed between the base frame and cover receiving frame.

This invention further is a method for adjusting a manhole height comprising the steps of: positioning a tubular shaped frame underground; placing a removable height adjusting member on the tubular shaped frame and mounting a cover receiving frame thereon; positioning a support in a space at an upper section of the manhole; setting an ascending base on a supporting base, said ascending base ascends relative to the supporting base; connecting the ascending base and the cover receiving frame by a connecting pole; lifting the cover receiving frame via the connecting pole as the ascending base ascends; forming a gap underneath the cover receiving frame; and removing the height adjusting member placed under the cover receiving frame or adding the height adjusting member under the cover receiving frame.

This invention further is a method for adjusting a manhole height comprising the steps of: positioning a tubular shaped frame underground; placing a removable height adjusting member on the tubular shaped frame; and mounting a cover receiving frame thereon; positioning a supporting base in a space at an upper section of the manhole; setting a press fitting base on a supporting base, said press fitting base ascends relative to the supporting base; connecting the ascending base and the cover receiving frame by a connecting pole; descending the cover receiving frame already ascended via the connecting pole as the press fitting base descends; and closing a gap underneath the cover receiving frame.

This invention further is a device for adjusting a manhole height comprising a tubular shaped frame positioned underground; a removable height adjusting member placed on the tubular shaped frame; a cover receiving frame mounted thereon; a supporting base positioned in a space at an upper section of the manhole; a base, ascending and descending relative to the supporting base; an ascensor installed between the supporting base and the ascending base; and a connecting member making a connection between the ascending base and the cover receiving frame.

This invention further is a device for adjusting a manhole height comprising a tubular shaped frame positioned underground; a removable height adjusting member placed on the tubular shaped frame; a cover receiving frame mounted thereon; a supporting base positioned in a space at an upper section of the manhole; a press fitting base ascending and descending relative to the supporting base; an ascensor installed between the supporting base and the press fitting base; and a connecting member making a connection between the ascending base and the cover receiving frame.

First Embodiment of the Invention

Figure 1:
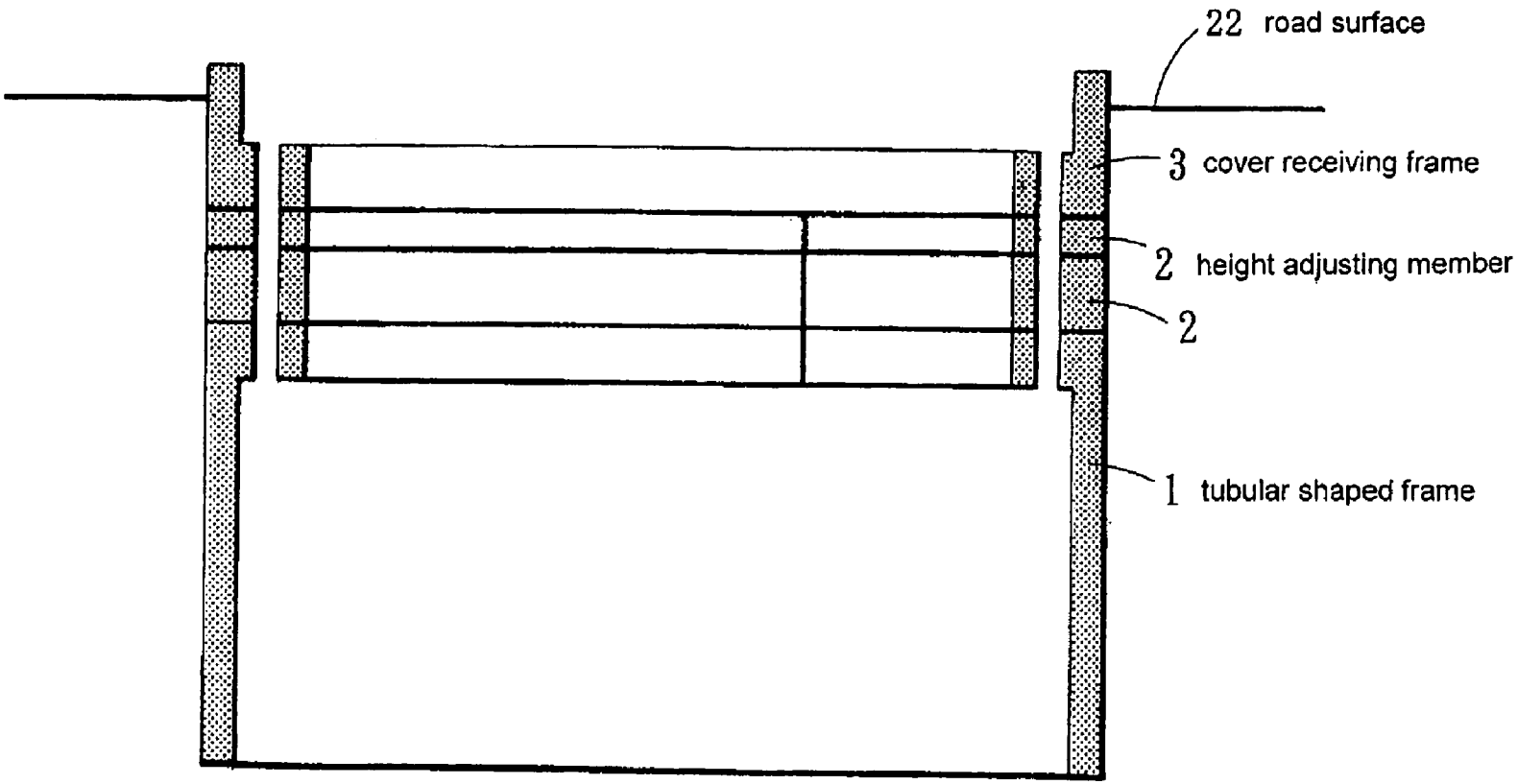
FIG. 1 is a view explaining a manhole condition in a first embodiment of the present invention where the road surface subsides leaving the manhole to be exposed thereabove.

A first embodiment of this invention with regard to a method and device for adjusting manhole height is explained with reference to the accompanying drawings.

1-1. Manhole Structure

A manhole in this invention may employ the identical structures as disclosed in conventional manholes.

For installment of the conventional manholes, a tubular shaped frame 1 is positioned underground; a removable height adjusting member 2 is placed on the tubular shaped frame 1; and a cover receiving frame 3 is placed thereon. The shape of the frame 1 is not limited to be only a cylindrical shape but may be any shape, such as a square shape for example.

Each height adjusting member 2 is arc-shaped and the height adjusting members 2 are able to be assembled to be combined together to form a tubular shaped unit and are capable of being disassembled in order to each be separate height adjusting members 2.

The tubular frame 1, the height adjusting members 2, and the cover receiving frame 3 have plural through holes, and each through hole on the tubular frame 1, the height adjusting members, and the cover receiving frame 3 are aligned to make one, vertical, slotted hole.

A bolt is inserted and screwed downward into each slotted hole to be tightened therein so as to integrate the tubular shaped frame 1, the height adjusting member 2 and the cover receiving frame 3.

If a peripheral covering tube 21 is installed to surround the height adjusting members 2, then the inside of the tubular frame 1 will not be exposed to surrounding soil when the height adjusting member 2 is removed, thereby preventing any pebbles from falling into the tubular frame 1.

The peripheral covering tube 21 may be installed when a target ground surface is selected for placing the tubular shaped frame 1 is dug and cleared for positioning the manhole therein.

1-2. Base Frame A4

This invention employs a base frame A4 positioned in a space above the manhole.

Later described drawing poles A5 may accompany this base frame A4.

Here, for example, plural legs A41 are connected to the base frame A4, which are designed such that the lower ends of the legs A41 are extended to the periphery of the manhole.

Each leg A41 has its lower end placed on a base plate A42 pressing the road surface around the periphery of the manhole and is supported thereon while receiving a reaction force of the base frame A4. Accordingly, when the cover receiving frame 3 is lifted, the base plate A42 prevents the surrounding pavement surface from lifting together with the cover receiving frame.

The legs A41 of the base frame A4 may be a grate if they are down-stretched and upwardly inclined toward the center of the manhole, and force bolts fitting in the base frame A4 are vertically screwed into bolt holes of the cover receiving frame 3.

Alternatively, the base frame A4 in a short tube-shape may be designed without the legs A41. As this short tube, an upper portion of the cone-like member is laterally cut to form a truncated cone base frame, and drawing poles vertically extending from upper portions of the base frame may be fit in the bolt holes formed on the cover receiving frame 3.

1-3. Drawing Pole A5

There are various types of the drawing pole designed to lift the cover receiving frame 3.

For example, each drawing pole A5 comprises a nut mounted on the base frame A4 and the force bolt screwed thereinto.

A lower end of the drawing pole A5 fits into the cover receiving frame 3, and the nut on the base frame A4 is rotated to elevate the cover receiving frame 3 at the lower end portion of the force bolt.

Alternatively, the drawing pole A5 may comprise a jack and a lifting member mounted on the base frame A4.

The lifting member may be a steel pole or a steel wire. The jack may be such as a publicly available screw jack and/or center hole jack.

Each lower end of the pulling member is fixed in the cover receiving frame 3, and the jack is operated to lift the pulling member up raising the cover receiving frame 3 positioned at the lower end portion of the pulling member.

Alternatively, various conventional lifting means may be used to lift the cover receiving frame 3, such as a lifting motor with a motor used to wind the steel wire, a pantograph mechanism, or an elevator.

1-4. Installment of the Drawing Pole A5

A method for adjusting the height of the cover receiving frame 3 when the cover receiving frame 3 is exposed and juts out above the road surface, due to ground subsidence, will be explained next.

Figure 2:
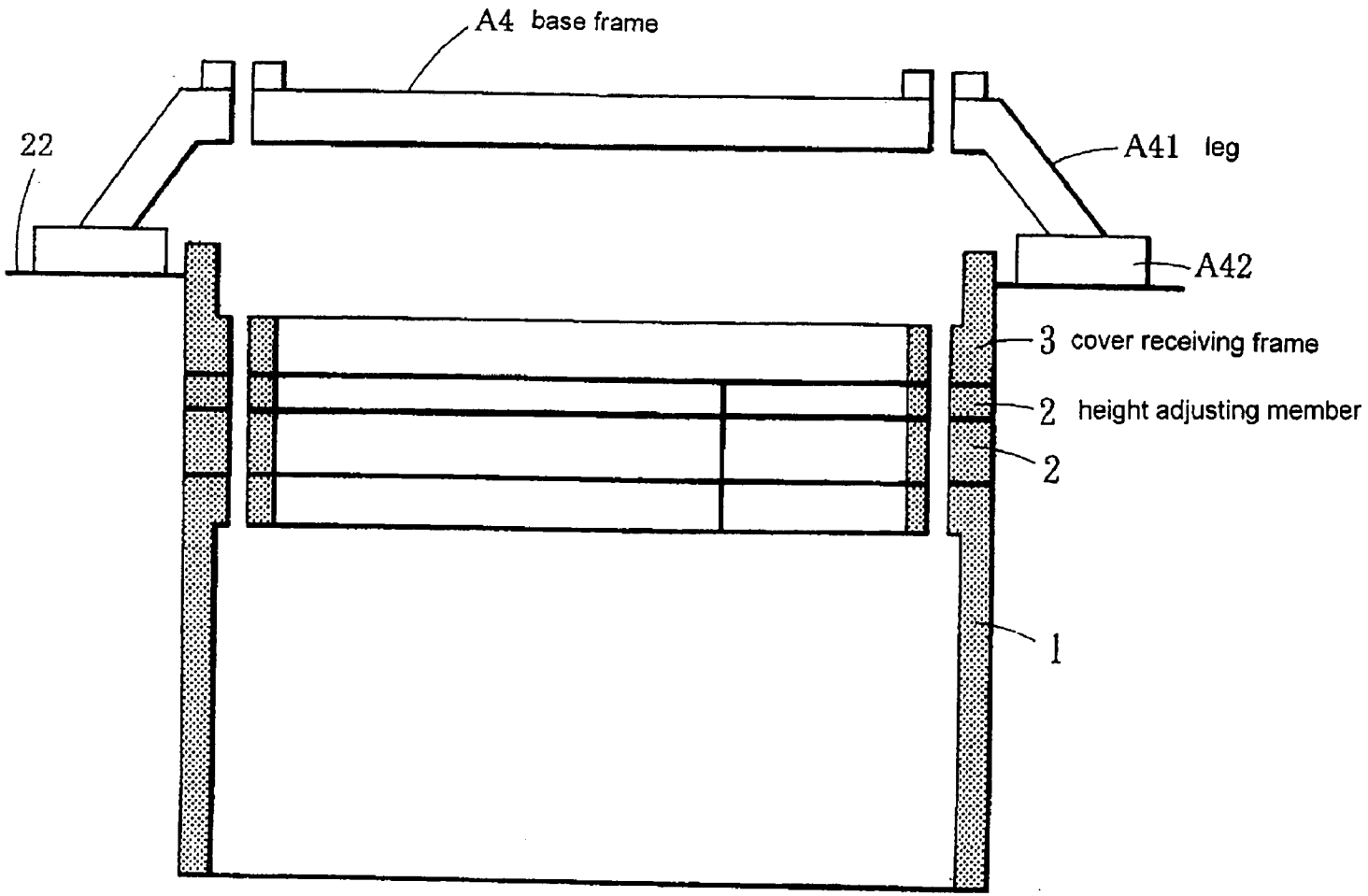
FIG. 2 is a view explaining a condition of a manhole in the first embodiment of the present invention where the height adjustment mechanism is installed.

To begin with, the manhole cover is removed and the base frame A4 is positioned in the space at the upper portion of the manhole without the cover (FIG. 2).

The force bolts that fit through the bolt holes of the tubular shaped frame 1, the height adjusting members 2, and the cover receiving frame 3 at the manhole side, are removed.

The ends of the drawing poles A5, installed in the base frame A4, fit in the cover receiving frame 3.

If the drawing poles A5 are bolt-like members, i.e., having threaded sections, the end portions of the threaded section may be screwed into the opened holes on the cover receiving frame 3 after removing the force bolts which were previously extended through the tubular shaped frame 1, the height adjusting members 2 and the cover receiving frame 3.

Alternatively, if separate bolt holes for lifting are placed in the cover receiving frame 3, the lower ends of the bolts may fit therein.

If the drawing poles A5 are steel poles or steel wires, the cover receiving frame 3 may be an L-shape in the cross-section and a base line of the L-shape extends toward the manhole center. The surface of the base line is designed to have plural holes through which the ends of the drawing poles A5 are placed and are to be fixed therein.

Figure 3:
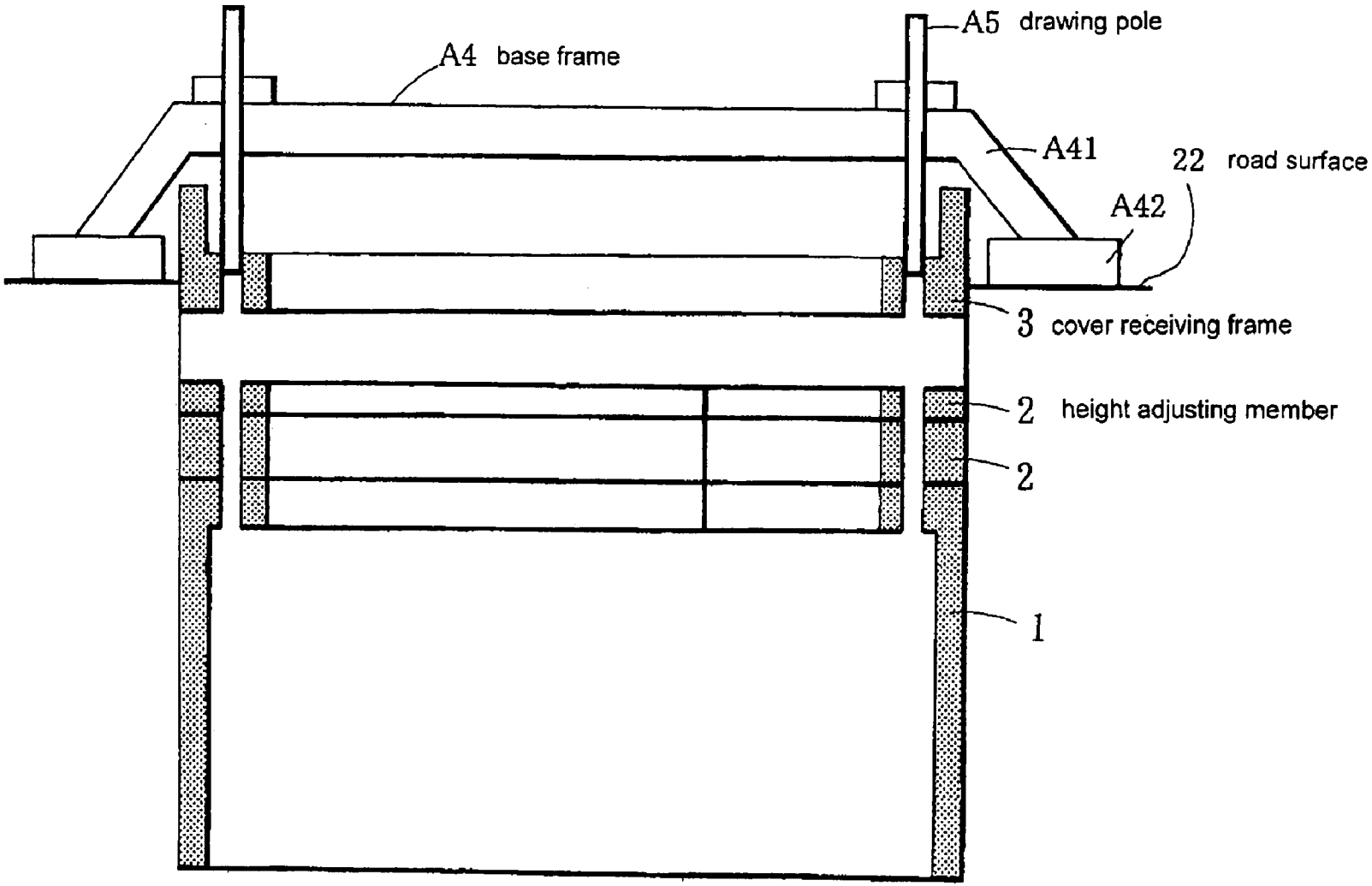
FIG. 3 is a view explaining a condition of a manhole in the first embodiment of the present invention where the cover receiving frame is being lifted.
Figure 4:
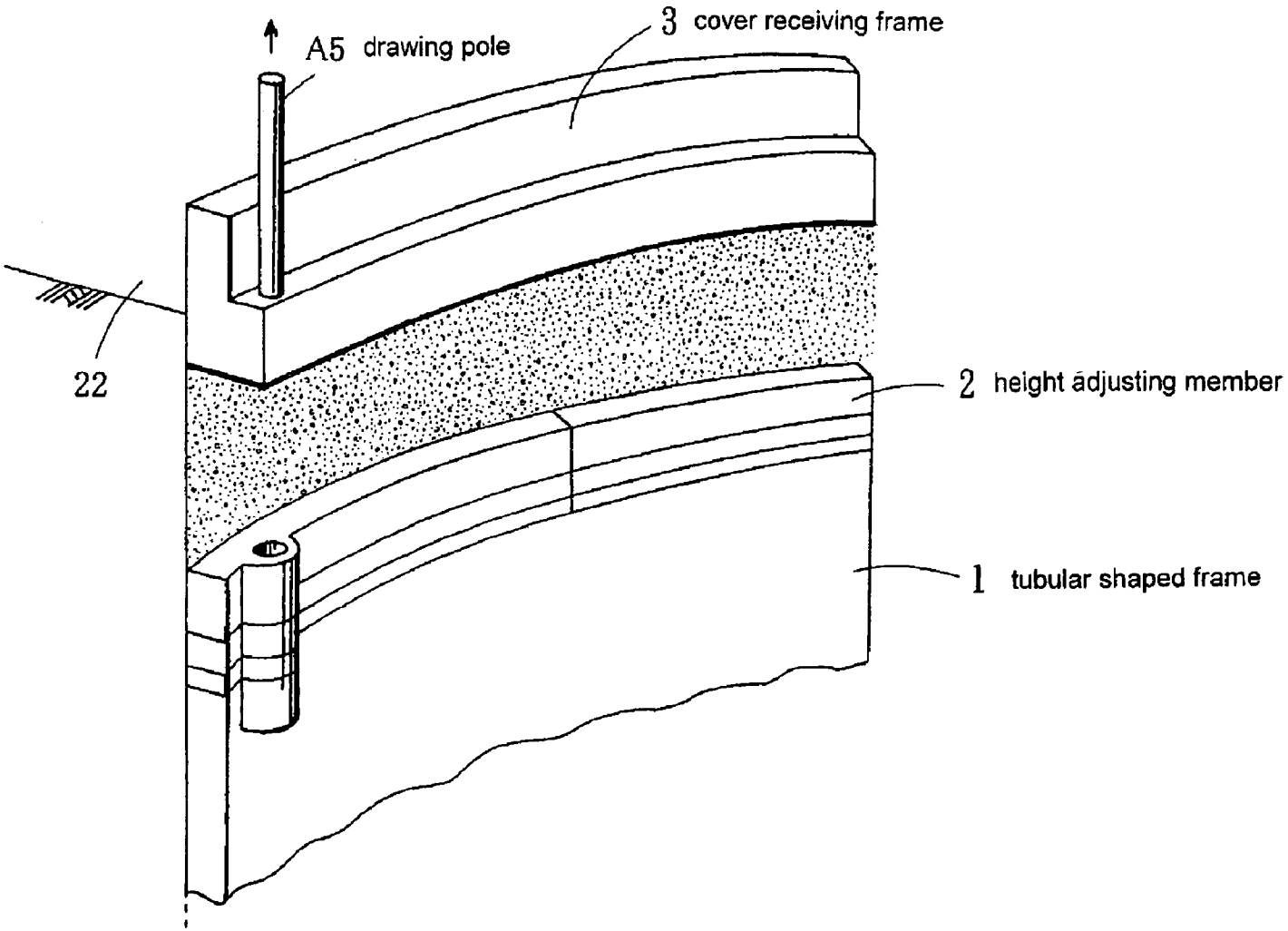
FIG. 4 is a perspective view of a condition of a manhole in the first embodiment in the present invention where a cover receiving frame is being lifted.

1-5 Lifting by the Drawing Pole A5 (FIGS. 3 and 4).

The nuts over the drawing poles A5 may be rotated or the lifting jack may be activated to raise the drawing poles A5. If the drawing poles A5 are long bolts, then, the nuts fitting over the bolts, while restricting the rotation of the bolts and being mounted on the base frame A4, may be rotated to draw the bolts without rotating the same. The same explanation may be made to the case when the bolts descend or are lowered.

As such, the lower ends of the drawing poles A5, installed in the cover receiving frame 3, ascend with a reaction force against the base frame A4. The cover receiving frame 3 also ascends together as the drawing poles A5 are drawn.

At that time, unlike the conventional manhole arts, the cover receiving frame 3 does not receive the reaction force against the height adjustment members 2 below, and therefore the cover receiving frame 3 and the height adjusting members 2 are completely separated.

Figure 5:
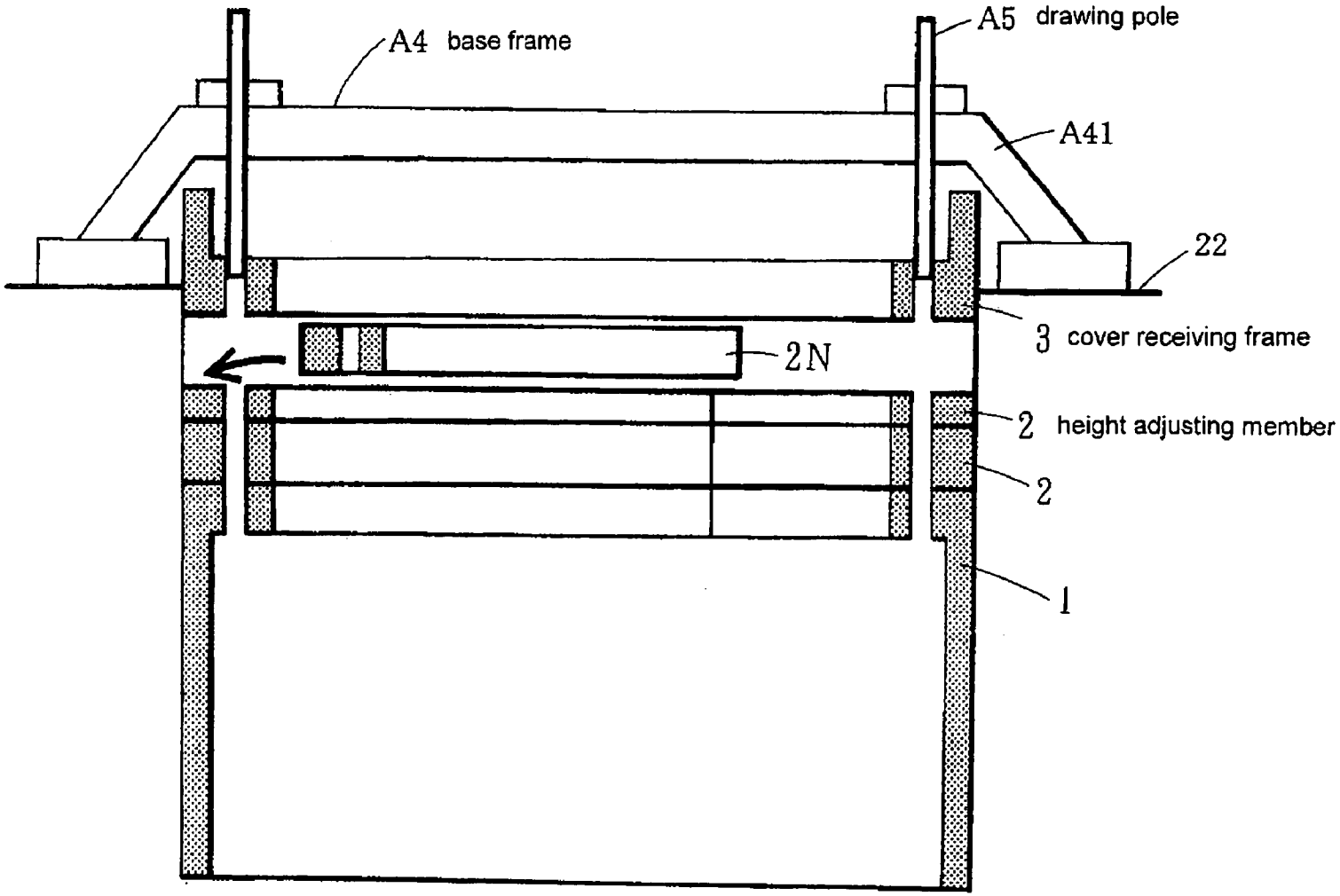
FIG. 5 is a view explaining a condition of a manhole in the first embodiment of the present invention where a new additional height adjusting member is added.
Figure 6:
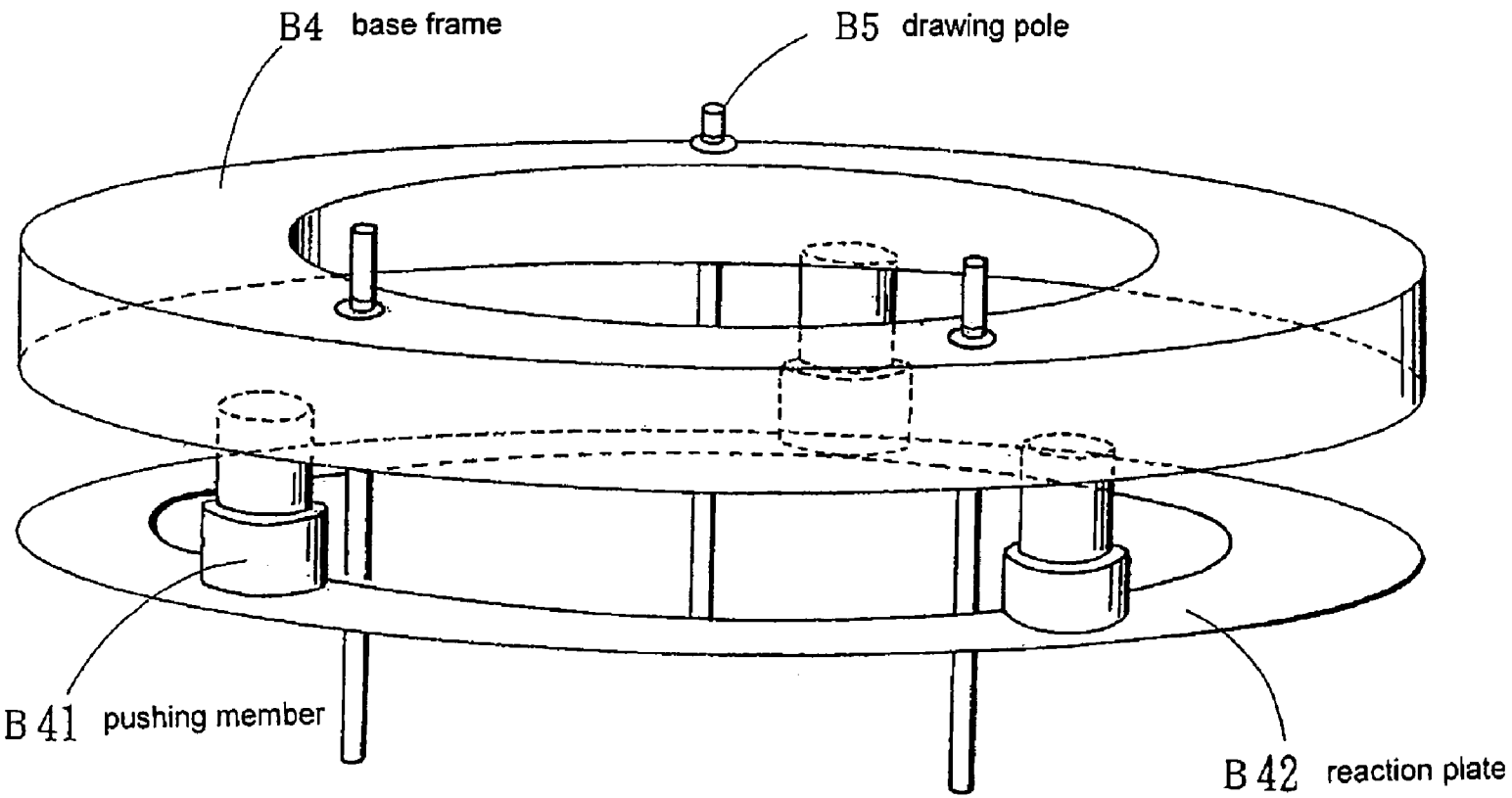
FIG. 6 is a view explaining a height adjustment mechanism in a second embodiment of the present invention.

1-6 Height Adjustment (FIG. 5).

Because the cover receiving frame 3 is completely separated from the height adjusting members 2 below, new additional height adjusting members 2N may be added at any location. Additionally, the height adjusting members 2 may be removed at any location.

Accordingly, this manhole does not require the height change of the force bolts, thereby providing a quick and safe process of adding or removing the level height adjustment members 2.

1-7 Pressing the Ground

When the base frame A4 is properly positioned, lower ends of plural legs A41 of the base frame A4 are placed on the ground around the periphery of the manhole. If the base frame A4 is a short tube then a bottom surface of the short tube lands on the periphery of the manhole.

The cover receiving frame 3 is lifted while the bottom surface, placed on the periphery of the manhole, generates the reaction force against the base frame A4. The legs A41 and the bottom surface of the base frame A4 press against the ground around the manhole preventing the pavement therearound from raising or from being pulled up.

Second Embodiment of this Invention

A second embodiment regarding a method for adjusting the height of the manhole in this invention and the adjusting device is explained here with reference to FIGS. 6–10.

2-1. Manhole Structure

The method and the device described in this embodiment are applicable and employable to the manhole of an identical structure of the previous embodiment using the height adjusting members.

2-2. Base frame B4

This invention employs a base frame B4 positioned in a space above the manhole.

The base frame B4 is a frame capable of having drawing poles B5 installed thereon and may be formed in various shapes, such as a circular shape or a rectangular shape, according to the shape of the manhole.

2-3. Drawing Pole

Plural pushing members B41 are sandwiched between the base frame B4 and the road surface 22 having a reaction plate B42 therebetween.

For example, vertically strokable jacks may be used as the pushing members B41 for the base frame B4. The jacks are not limited to hydraulic/oil jacks but may be any of the various conventional jacks such as screw jacks, pneumatic/air jacks, or pantograph jacks.

Plural jacks are connected with one pump via connecting pipes. For example, one manual pump supplies air pressure or hydraulic pressure to the pushing member B41 to either ascend or descend the entire base frame B4 evenly.

The pushing members that are comprised of nuts mounted on the base frame B4 and vertical bolts may be used to rotate the bolt stem to ascend or descend the base frame B4.

Alternatively, various mechanisms generally known to the public, e.g., a mechanism designed to convert rotation into either an ascending or descending movement, such as a combination of a rack and pinion, may be employed here.

2-4. Reaction Plate

Reaction plates B42 may be placed underneath the lower ends of the pushing members B41 ascending the base frame B4. The reaction plates B42 encircle the ground around the periphery of the manhole.

When the base frame B4 ascends, the reaction force of the pushing members B41 is transmitted to the road surface 22 around the periphery of the manhole via the reaction plates B42, thereby preventing the ground therearound from arising while lifting the cover receiving frame 3. Accordingly, when the cover receiving frame 3 is lifted, the reaction plate B42 prevents the surrounding pavement surface from rising up together with the cover receiving frame 3.

2-5. Drawing Pole B5

Various types of drawing poles B5 may be used to lift or raise the cover receiving frame 3.

For example, each drawing pole B5 comprises a nut mounted on the base frame B4 and the force bolt screwed thereinto.

Alternatively, publicly available steel poles or steel wires may be employed as the drawing poles B5.

If each lower end of the drawing poles B5 is fixed in the cover receiving frame 3 while each upper end thereof is fixed in the base frame B4 to ascend the base frame B4, the cover receiving frame 3, in which the lower ends of the drawing poles B5 are installed, may be lifted as a result.

2-6. Installment of the Drawing Pole B5

If the road surface subsides, the cover and the cover receiving frame 3 of the manhole will be exposed above the road surface. A method for adjusting the height of the cover receiving frame 3 when the cover and the cover receiving frame 3 are exposed will be explained next.

Figure 7:
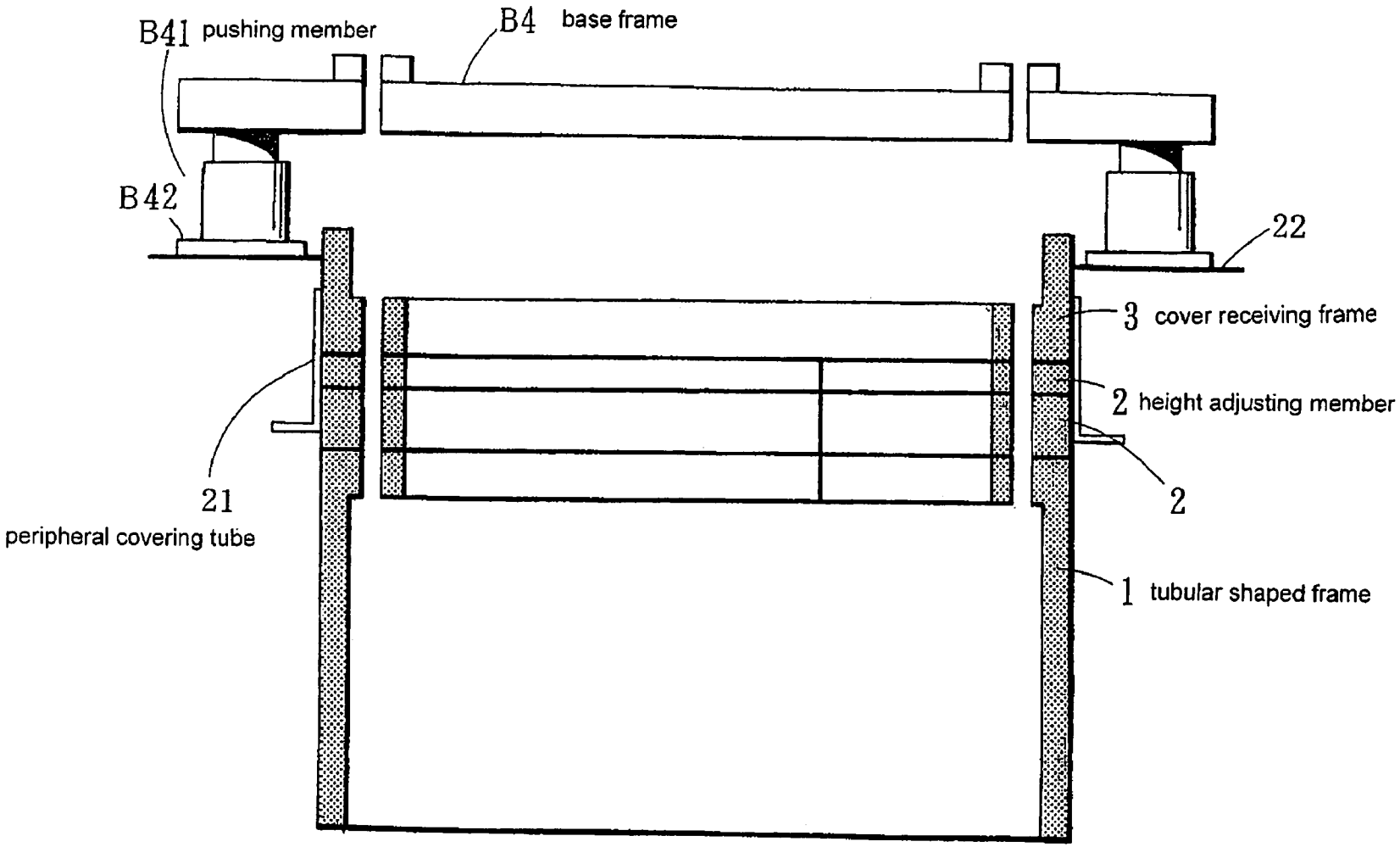
FIG. 7 is a view explaining a condition of a manhole in the second embodiment of the present invention in which a height adjustment member is installed.

To begin with, the manhole cover is removed and the base frame B4 is positioned in a space at the upper portion of the manhole without the cover. FIG. 7

The force bolts, fitting through the bolt holes of the tubular shaped frame 1, the height adjusting members 2, and the cover receiving frame 3 at the manhole side, are removed.

The ends of the drawing poles B5, installed in the base frame B4, fit in the cover receiving frame 3.

If the drawing poles B5 are bolt-like members, i.e., having threaded sections, the end portions of the threaded section may be screwed into the opened holes in the cover receiving frame 3, after removing the force bolts which were previously extended through the tubular frame 1, the height adjusting members 2 and the cover receiving frame 3.

Alternatively, if separate bolt holes for lifting are placed in the cover receiving frame 3, the lower ends of the bolts may fit therein.

If the drawing poles B5 are steel poles or steel wires, the cover receiving frame 3 may be L-shaped in cross-section and a base line of the L-shape extends toward the manhole center. A surface of the base line is designed to have plural holes through which the ends of the drawing poles B5 are placed therethrough and are to be fixed therein.

Figure 8:
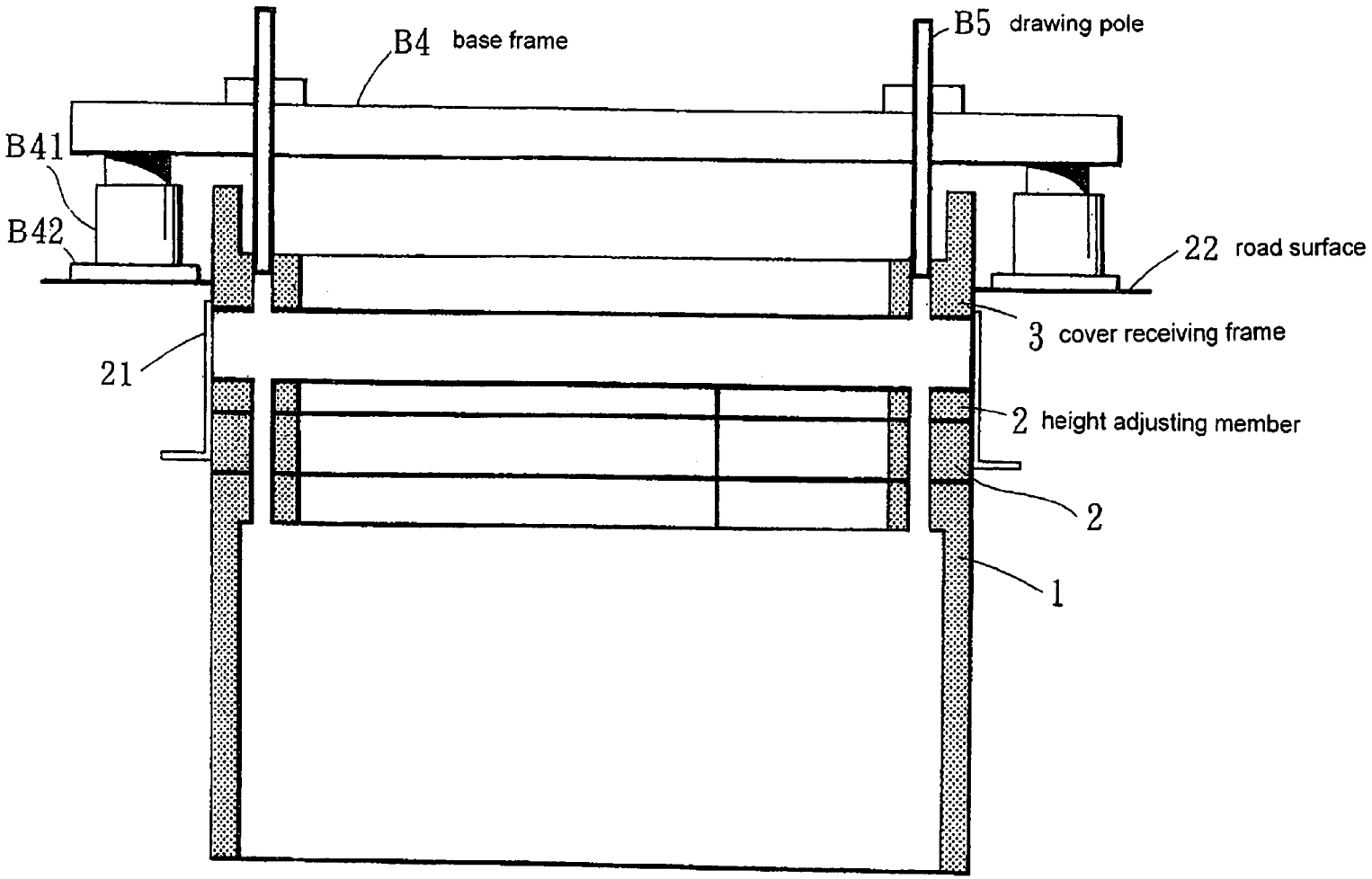
FIG. 8 is a view explaining a condition of a manhole of the second embodiment in the present invention where a cover receiving frame is being lifted.
Figure 9:
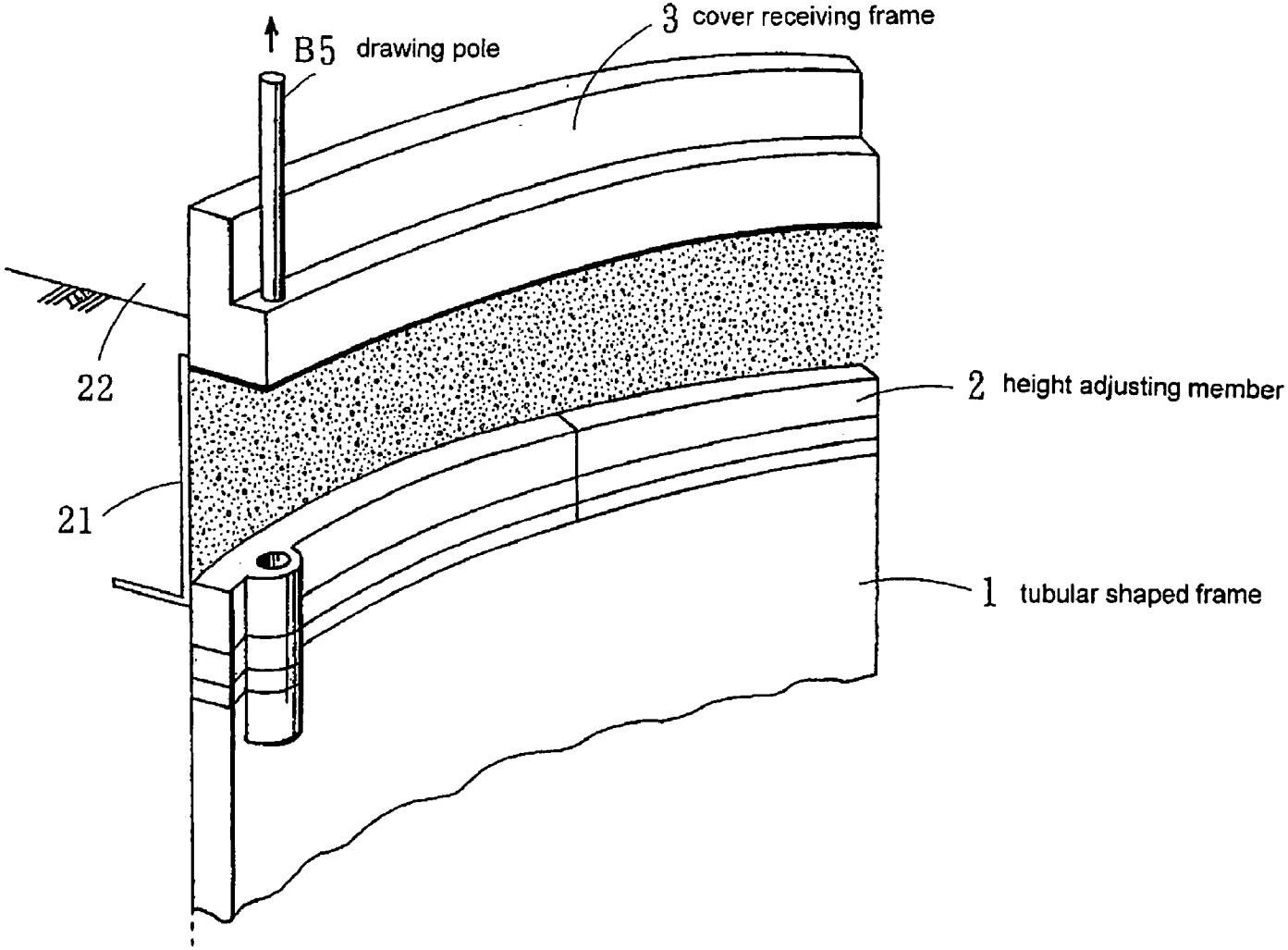
FIG. 9 is a perspective view of a condition of a manhole in the second embodiment of the present invention where a cover receiving frame is being lifted.

2-7. Pushing of the Base Frame (FIGS. 8 and 9)

The pushing members B41 push the base frame B4 up.

The base frame B4 is being pushed upward and the drawing poles B5, whose lower ends are installed in the cover receiving frame 3 causes the cover receiving frame 3 to ascend or to be pulled upward as the drawing poles B5 are drawn upward.

Unlike the conventional arts, the cover receiving frame 3 does not receive the reaction force against the height adjustment members 2 below. The height adjusting members B do not exist between the cover receiving frame 3 and the height adjusting members 2, and therefore the cover receiving frame 3 and the height adjusting members 2 are completely separate.

Figure 10:
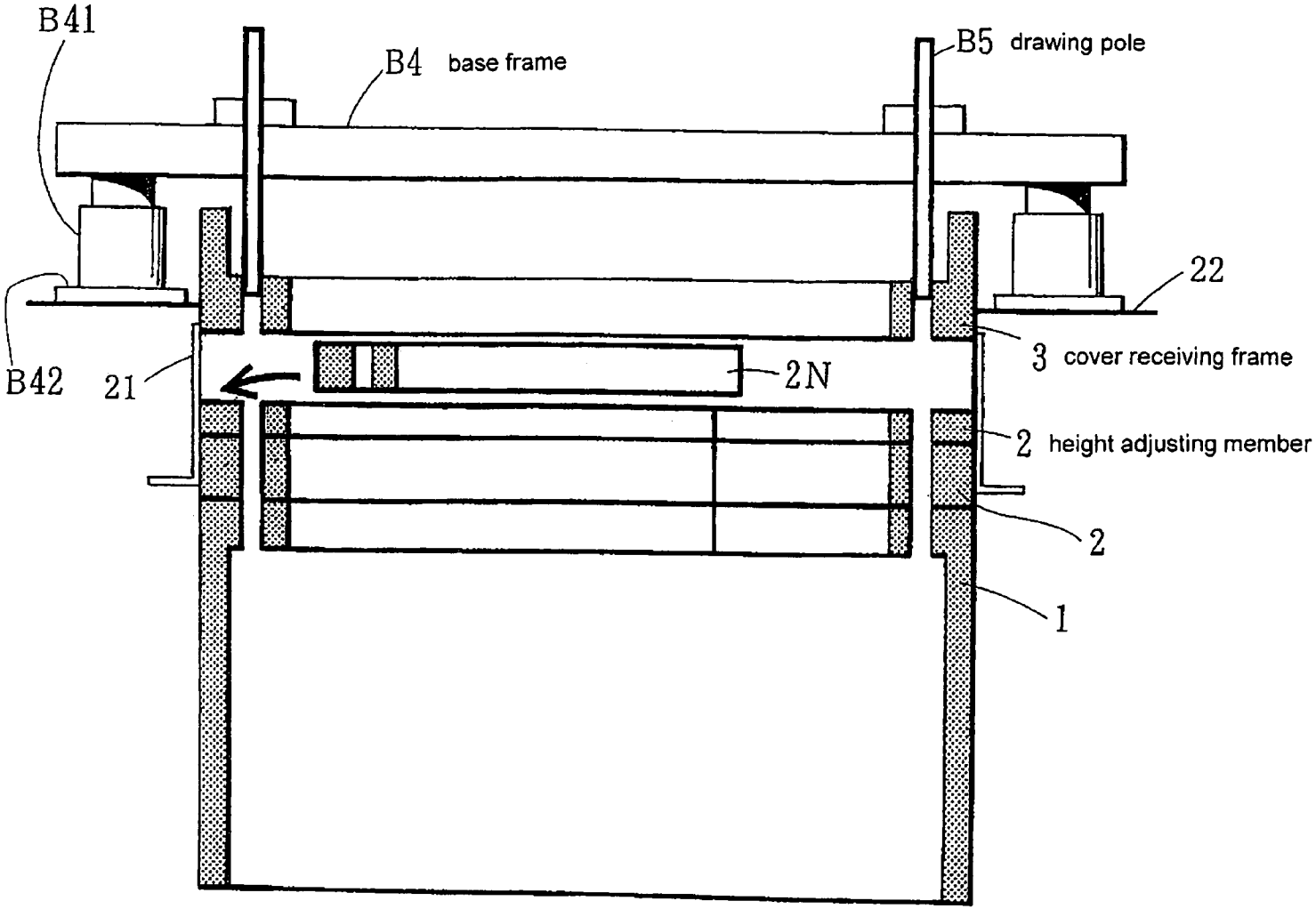
FIG. 10 is a view explaining a condition of a manhole in the second embodiment of the present invention where a new additional height adjusting member is added.

2-8. Addition of Height Adjusting Members (FIG. 10)

Because the cover receiving frame 3 is completely separated from the height adjusting members 2 below, new additional height adjustment members 2N may be added at any location.

Conversely, the height adjusting members 2 may be removed at any location.

Accordingly, this manhole does not require the height change of the force bolts as is required in the conventional manholes, thereby providing a quick and safe process for adding or removing the height adjusting members 2.

2-9. Pressing the Ground

When the base frame B4 is properly positioned around the manhole the lower ends of plural legs B41 of the base frame B4 are placed on the ground around the periphery of the manhole.

The cover receiving frame 3 may be lifted while the bottom surface, placed on the periphery of the manhole, generates a reaction force against the base frame B4. Then, the bottom surface of the legs B41 and the reaction plate B42 press against the ground around the manhole thus preventing the pavement, such as an asphalt surface therearound, from raising.

Third Embodiment of this Invention

A third embodiment of this invention, a method and device for adjusting the height of a manhole, is explained with reference to the accompanying drawings.

3-1. Manhole Structure

The method and the device described in this embodiment are applicable and employable to a manhole having the identical structure of the previous embodiments using the height adjusting members.

3-2. Base frame C4

A base frame C4 is a joist-like supporting member laterally positioned in an upper space of a manhole that receives a reaction force due to lifting and lowering of a cover receiving frame 3.

Surrounding portions of the base frame C4 are supported by plural supporting posts C41 in order to position the base frame C4 in the upper space of the manhole.

The plural supporting posts C41 are equally arranged at the surrounding portions of the base frame C4 along the manhole shape. Each supporting post C41 has a base plate underneath.

In consideration of the plural supporting posts C41 equally arranged at the surrounding portions of the base frame C4 along the manhole shape, one larger tube shaped member may be substituted for the plural supporting posts C41 so as to eliminate the need for independent supporting posts C41.

The base frame C4 has an ascensor C51 or plural ascensors C51 equally positioned at or around a central region thereof.

Figure 11:
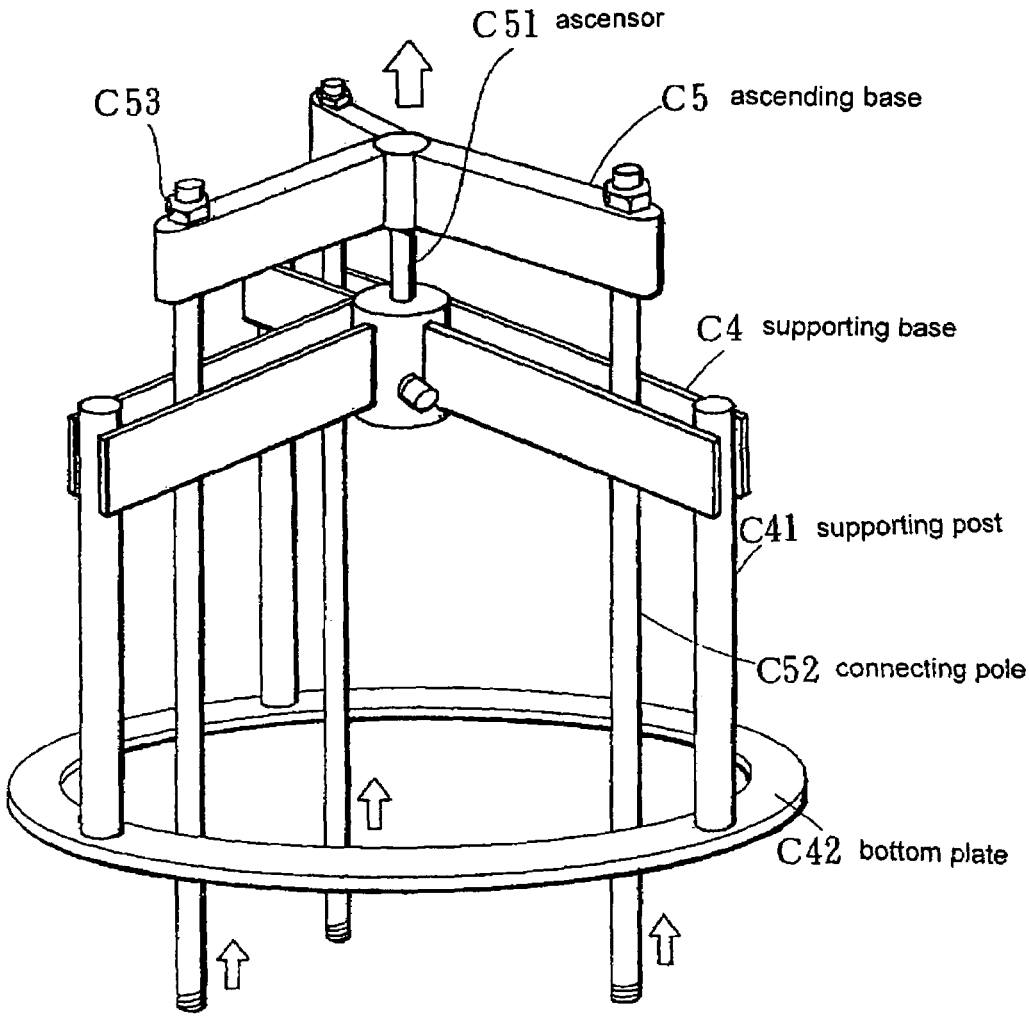
FIG. 11 is a view explaining a height adjustment mechanism in a third embodiment of the present invention.

An example as shown in FIG. 11 shows the base frame C4 with one ascensor C51 at the center thereof and three beams vertically extending at radial positions thereof. However, the base frame C4 may be a disc-shape, a rectangular-shape, or any other possible shapes.

3-3. Ascending Base C5

An ascending base C5 is positioned in an upper space above the supporting base C4 or a lower space below the supporting base C4.

This ascending base C5 ascends or descends its position relative to the fixed supporting base C4.

As shown in the FIG. 5 example, although the base frame C4 may comprise one ascensor C51 at the center thereof and three beams vertically extending at radial positions thereof, base frame C4 may be a disc-shape, a rectangular-shape, or any other possible shapes.

The ascending base C5 has the later described connecting poles C52.

3-4. Ascensor C51

One or plural ascensors C51 may be installed between the supporting base C4 and the ascending base C5

For example, vertically strokable jacks may be used as the ascensor C51. The jacks are not limited to hydraulic/oil jacks but may be any of the various conventional jacks such as manual screw jacks, pneumatic/air jacks, or pantograph jacks.

Alternatively, nuts may be mounted on the supporting base C4 and bolts may be used as the ascensors C51, so that the ascending base C5 may ascend or descend by rotating the bolt via a ratchet engagement.

Alternatively, various mechanisms generally known to the public, e.g., a mechanism designed to convert rotation into either an ascending or descending movement, such as a combination of a rack and pinion, may be employed here.

Plural jacks are connected with one pump via connecting pipes, and, for example, one manual pump supplies air pressure or hydraulic pressure to the ascensor C51 so as to push base C5 to either ascend or descend the entire base frame B4 evenly.

The ascensor C51 may be comprised of only one jack, which eliminates the need of adjusting the speed among plural jacks.

The ascensor C51 may be comprised of plural jacks, which provides more stable ascending and descending of base C5 because of the weight dispersion.

3-4. Bottom Plate

The supporting post C41 supporting the supporting base C4 has a base plate underneath. The bottom plate is designed to be circularly positioned on the ground around the periphery of the manhole.

When the base C5 ascends the reaction force of the ascensor C51 is transmitted to the road surface around the periphery of the manhole via the bottom plate, thereby preventing the ground therearound from arising by ascending the cover receiving frame 3.

Accordingly, when a cover receiving frame 3 is lifted, the bottom plate prevents the surrounding pavement surface from raising together with the cover receiving frame 3.

3-6. Connecting Pole C52

Connecting poles C52 are vertically extended from the base C5.

Various conventional structures may be employed in the connecting poles C52, but each connecting pole C52 has a lower end mounted to the cover receiving frame 3, which lifts the cover receiving frame 3 by means of ascending the base C5.

For example, the connecting pole C52 may comprise a long steel pole with a threaded section at an end thereof and a nut mounted on the ascending base C5 making a screw engagement with the threaded section.

Alternatively, publicly available steel poles or steel wires may be employed as the connecting pole C52.

If each lower end of the connecting poles C52 is fixed in the cover receiving frame 3 while each upper end thereof is fixed in the supporting base C4 to ascend the base C5, then the cover receiving frame 3, in which the lower ends of the connecting poles C52 are installed, may ascend as a result of the connecting pole movement.

The cover receiving frame 3 firmly attaches to the surrounding pavement, and therefore, an initial step of loosening the manhole rim requires large tension force. At that time, if the connecting poles C52 and the ascending base C5 are tied together by bolts C53, the initial manhole rim may be loosened by rotating the bolts C53.

3-7. Press Fitting Base C6

After the cover receiving frame 3 is lifted it needs to be lowered to close the gap thereunder.

This descending process may be accomplished by descending the base C5. However, a press fitting base C6 may be provided in addition to the base C5.

Just like the base C5, the fitting base C6 is positioned in an upper space above the supporting base C4 or a lower space below the supporting base C4.

This fitting base C6 also ascends or descends its position relative to the fixed supporting base C4. Similar to the supporting base C4, although the fitting base C6 may comprise three beams vertically extending at radial positions thereof, the supporting base C4 may be a disc-shape, a rectangular-shape, or any other possible shapes.

Connecting poles C52 are removably installed in the press fitting base C6 via nuts.

When the press fitting base C6 is positioned at an opposite side of the base C5 relative to the supporting base C4 as shown in an example, if a hydraulic/oil pressure jack is used as the ascensor C51, ascending of the base C5 and descending of the press fitting base C6 may be facilitated by means of swinging the hydraulic/oil pressure jack in both directions.

3-8. Step of Fixing Connecting Pole C52 and Cover receiving Frame 3

A method for adjusting the height of the cover receiving frame 3 will be explained next.

If the road surface subsides, the cover and the cover receiving frame 3 of the manhole will be exposed above the road surface.

Figure 12:
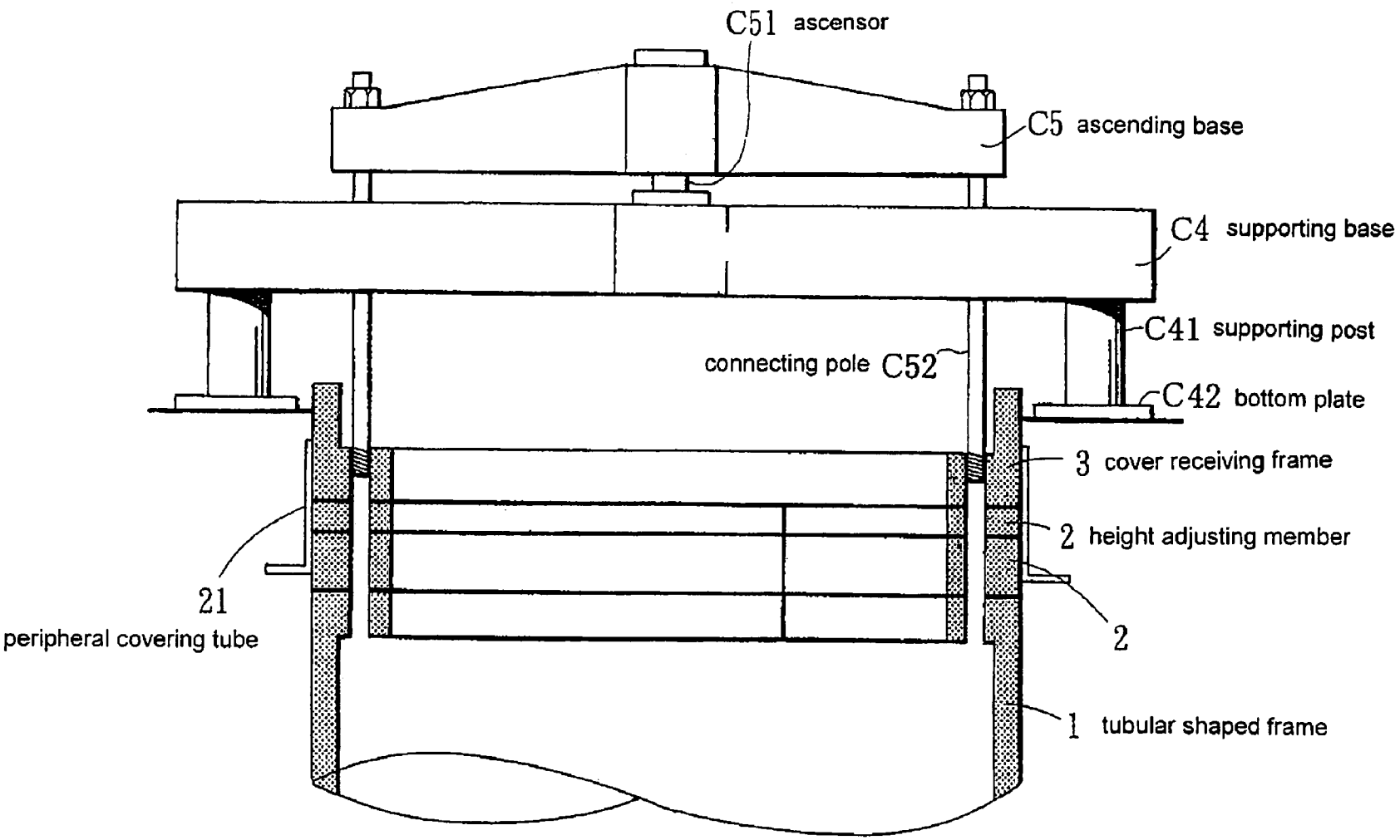
FIG. 12 is a view explaining a condition of a manhole in the third embodiment of the present invention where the height adjustment mechanism is mounted in a space at an upper side of the manhole.

To begin with, the manhole cover is removed and the supporting base C4 and the base C5 are positioned in a space at an upper portion of the manhole without the cover (FIG. 12).

The force bolts, fitting through the bolt holes of the tubular shaped frame 1, the height adjusting members 2, and the cover receiving frame 3 at the manhole side, are removed.

The ends of the connecting poles C52 installed in the base C5 fit in the cover receiving frame 3.

If the connecting poles C52 are bolt-like members, i.e., having threaded sections, then the end portions of the threaded sections may be screwed into holes opened on the cover receiving frame 3 after removing the force bolts which were previously extending through the tubular frame 1, the height adjusting members 2, and the cover receiving frame 3.

Alternatively, if separate bolt holes for lifting are opened on the cover receiving frame 3, the lower ends of the bolts may fit therein.

If the connecting poles C52 are steel poles or steel wires, the cover receiving frame 3 may be an L-shape in cross-section and a base line of the L-shape extends toward the manhole center. The surface of the base line is designed to have plural holes through which the ends of the connecting poles C52 are placed and are to be fixed therein.

Figure 13:
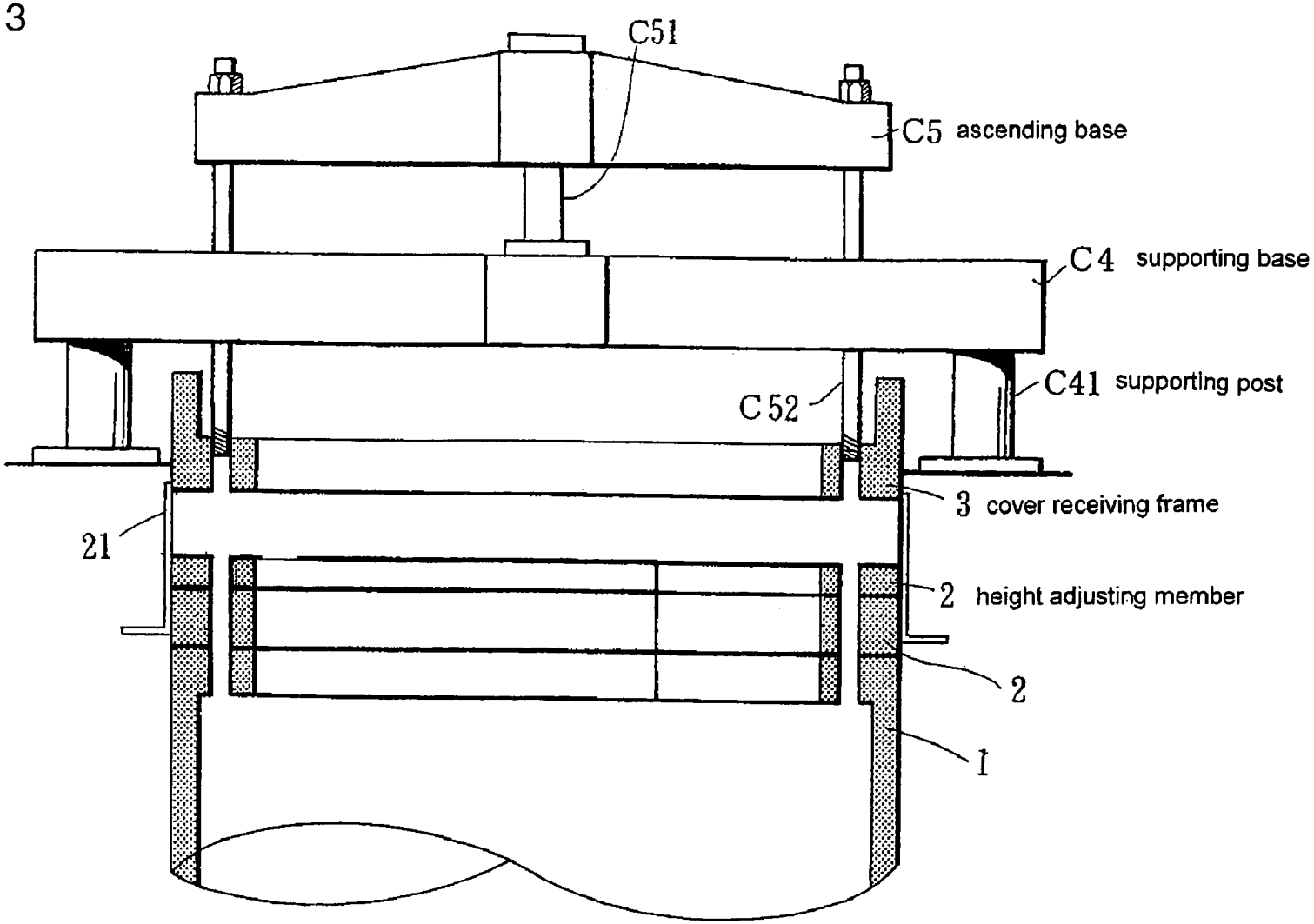
FIG. 13 is a view explaining a condition of a manhole in the third embodiment of the present invention where a cover receiving frame 3 is being lifted.
Figure 14:
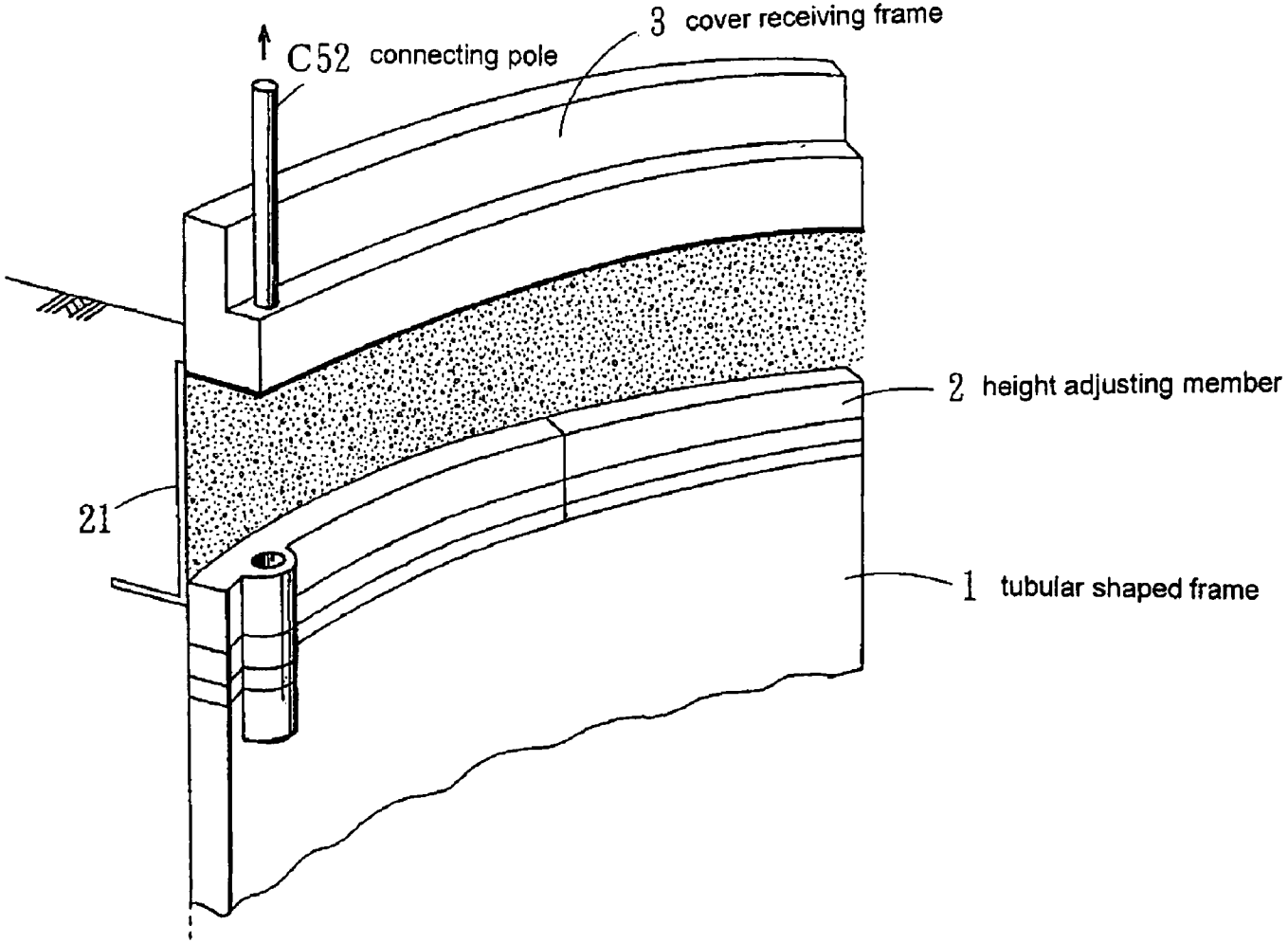
FIG. 14 is a perspective view of a condition of a manhole in the third embodiment of the present invention where a cover receiving frame 3 is being lifted.

3-9 Step of Ascending the Base Frame (FIGS. 13 and 14)

The ascensor C51 lifts the base C5.

As the base C5 is lifted, the connecting poles C51, which have the lower ends installed in the cover receiving frame 3, lifts the cover receiving frame 3. The cover receiving frame 3 also ascends together as the connecting poles C52 are drawn upward.

At that time, unlike the conventional arts, because the cover receiving frame 3 does not receive the reaction force against the height adjustment members 2 below, the height adjusting members B, which cannot be removed, do not exist between the cover receiving frame 3 and the height adjusting members 2, and therefore the cover receiving frame 3 and the height adjusting members 2 are completely separated.

Figure 15:
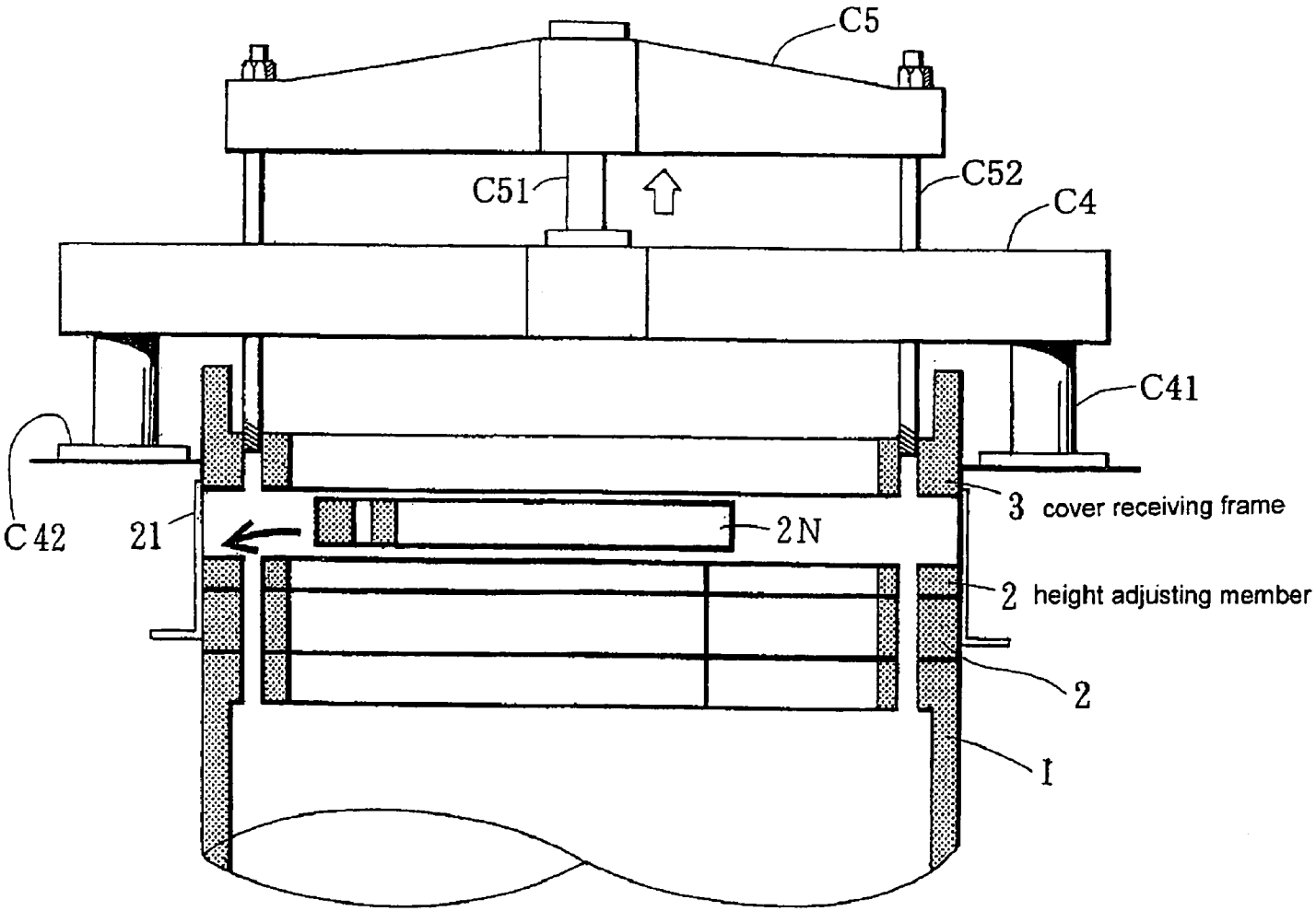
FIG. 15 is a view explaining a condition of a manhole in the third embodiment of the present invention where a new additional height adjusting member is added.
Figure 16:
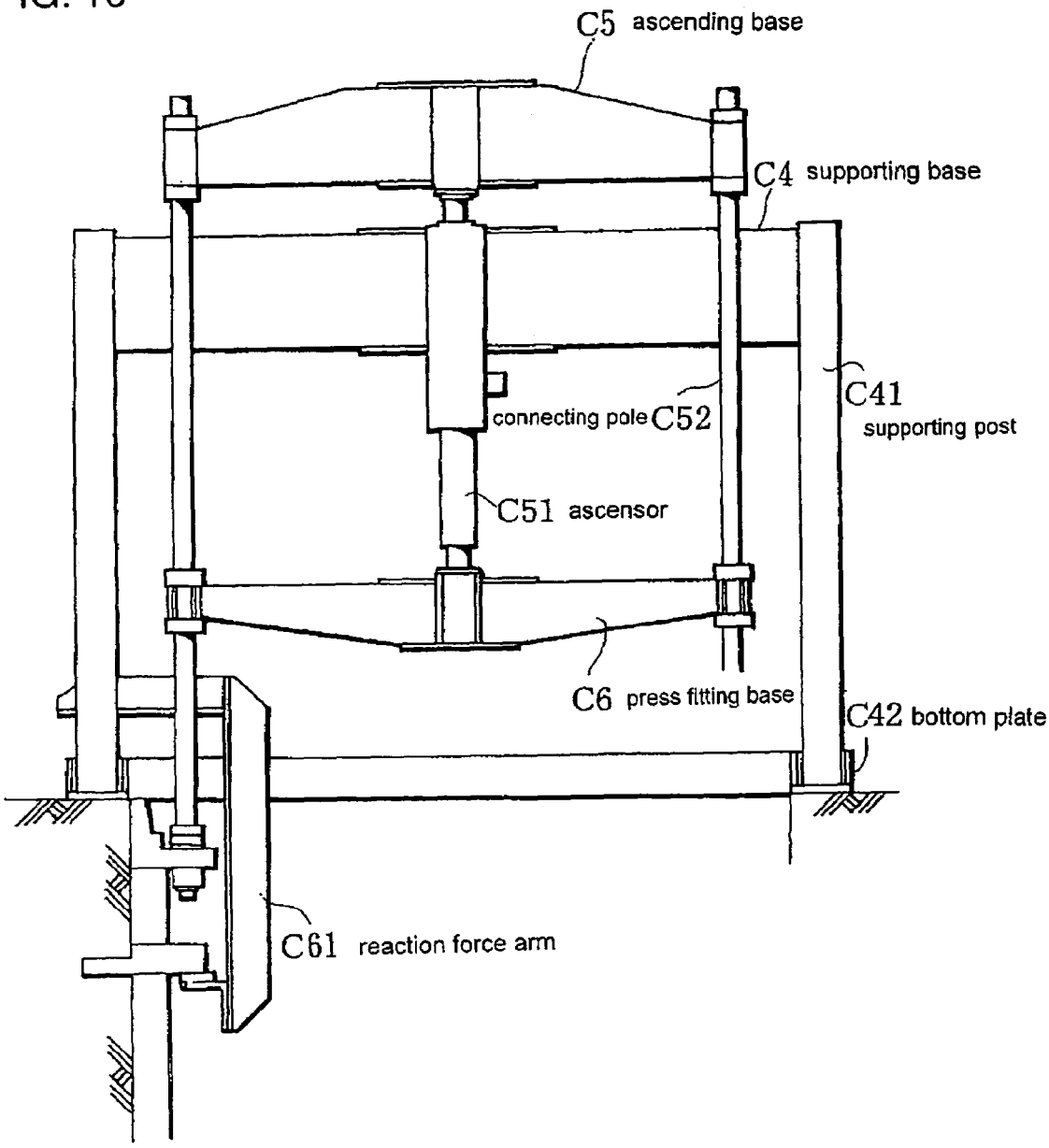
FIG. 16 is a view explaining a manhole structure having a press fitting frame separately from a lifting frame.
Figure 17:
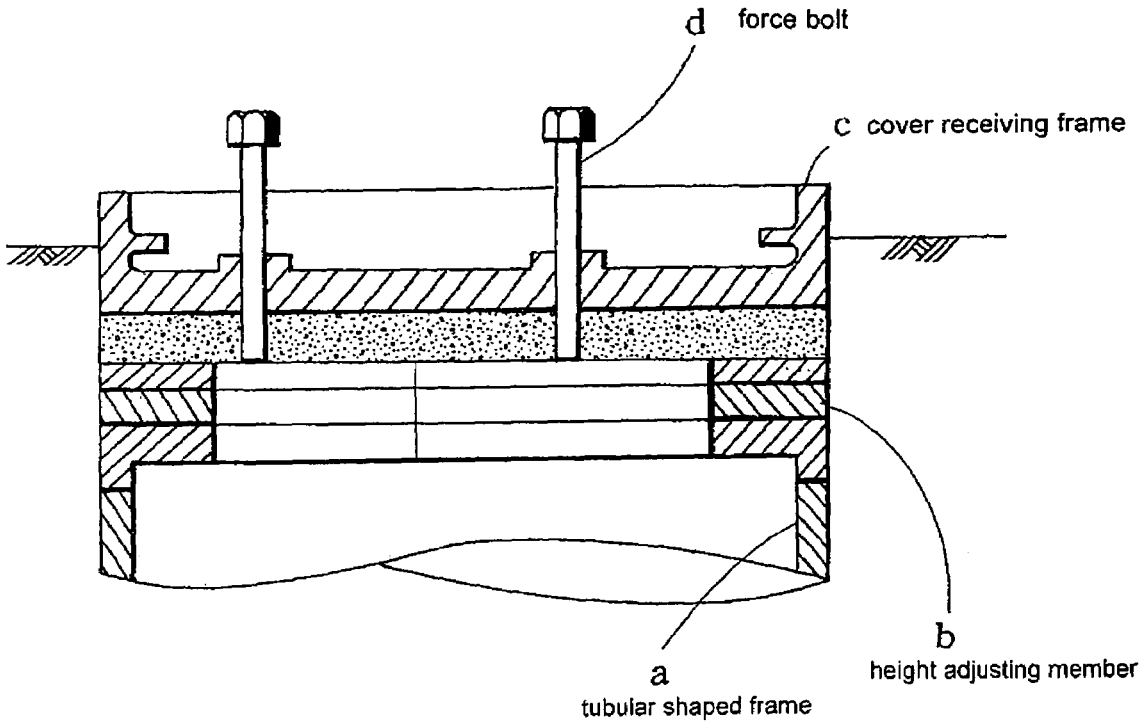
FIG. 17 is a view explaining a conventional height adjustment mechanism.
Figure 18:
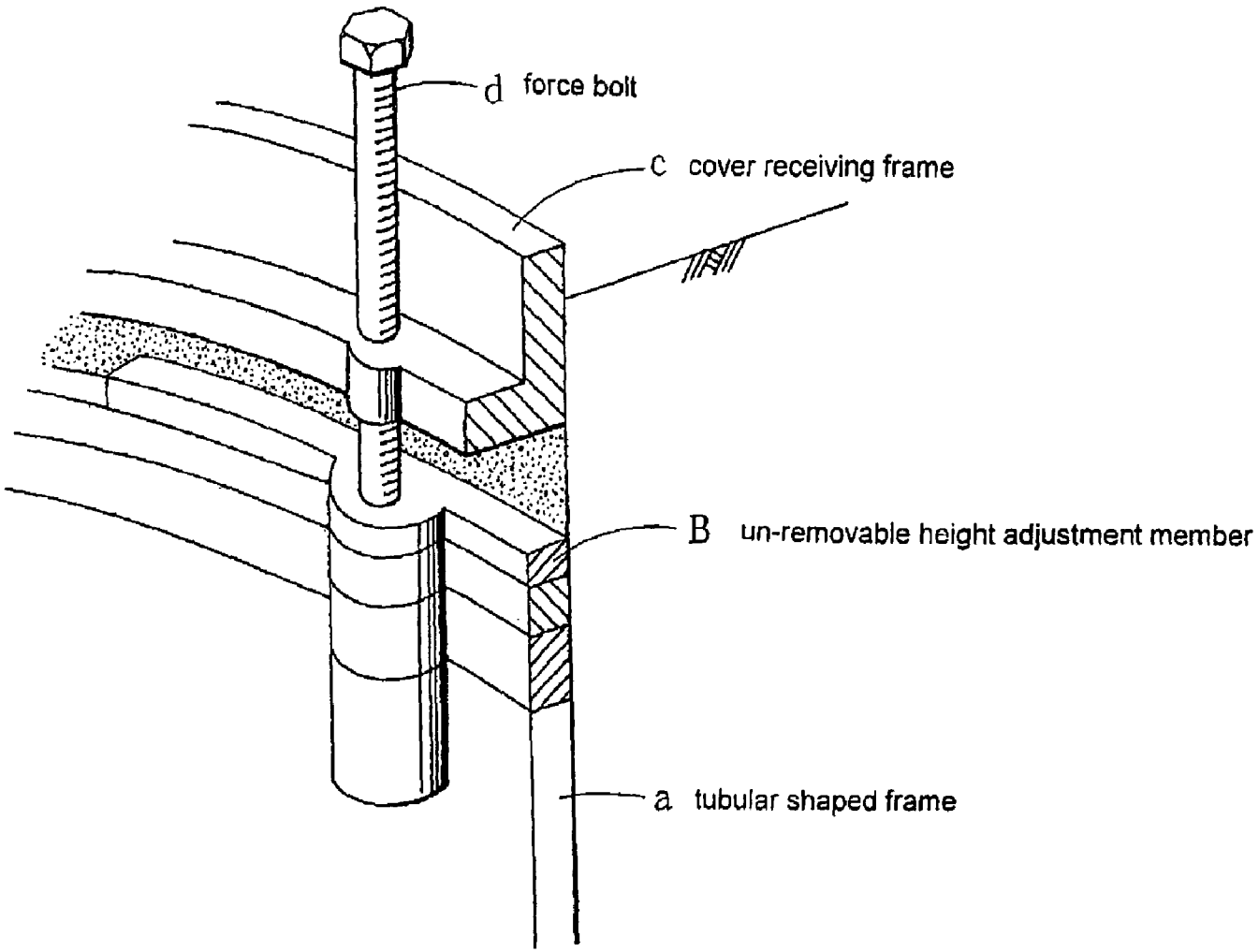
FIG. 18 is a view explaining positions with regard to the conventional non-removable height adjustment member and a force bolt.

3-10 Addition of Height Adjusting Members (FIG. 15)

Because the cover receiving frame 3 is completely separated from the height adjusting members 2 below, new additional height adjusting members 2N may be added at any location.

In other words, the height adjusting members 2 may be removed at any location.

Accordingly, this manhole does not require the height change of the force bolts as is required in the conventional manholes, thereby providing a quick and safe process of adding or removing the height adjusting members 2.

3-11 Pressing the Ground

The reaction force of the lifting operation of base C5 is transmitted to the ground via the supporting posts C41 located around the periphery of the manhole.

For that purpose, the bottom plates press the ground around the manhole, thereby preventing the pavement, such as an asphalt surface therearound, from raising.

3-12 Step of Descending the Cover Receiving Frame 3

The cover receiving frame 3, once ascended, needs to be descended to be in an appropriate position.

For that purpose the base C5 needs to be descended or the press fitting base C6 needs to be descended.

Then, the connecting poles C52 descend and the cover receiving frame 3 connected at the lower ends of the connecting poles C52 also descends to be in an appropriate position.

At that time, if the reaction force to descend is insufficient, one end of a reaction force arm C61 is connected to the supporting posts C41. The other end of the reaction force arm C61 engages with a stationary portion within the manhole, such as with the tubular shaped frame.

The reaction force of the press fitting is transmitted to frames like the manhole via the press fitting base C6, the ascensor C51, the supporting base C4, and the reaction force arm C61, thereby facilitating the press fitting process The same could be said when the press fitting base C6 is used in addition to the base C5 or a member with the combined functions of the base C5 and the press fitting base C6 is used.

Advantages of this Invention

The method and device for adjusting the manhole height in this invention is designed to lift the cover receiving frame instead of only pushing the cover receiving frame, as is shown in the conventional arts. Accordingly, this invention has the following advantages.

1. The cover receiving frame and the height adjusting members 2, at its lower side, are completely separated. Therefore, an additional height adjusting member 2 may be placed in any location and also the height adjusting member 2 may be removed at any location, which increases the efficiency of the entire operation.

2. Because of the above described efficiency, this invention provides an effective adjusting method and a device, especially for a manhole located in a busy road.

3. The reaction force of the lifting operation of the cover receiving fame 3 is transmitted to the ground around the periphery of the manhole via the legs of the base frame and the bottom surfaces. Accordingly, the larger the resistance of lifting the cover receiving frame 3 is the more effective the prevention of damages to the ground and the pavement is because the ground around the manhole is firmly secured by the base frame and the bottom surfaces.

4. In the method and the device of embodiment 3, the cover receiving frame 3, once lifted by the ascending base or the press fitting base separate from the ascending base, may be press-fit, thereby completing the adjustment quickly.

It is readily apparent that the above-described invention is advantageous for use in wide commercial utility. It may be understood that the specific form of the invention hereinabove is intended to be representative only, and certain modifications within the scope of these teachings will be apparent to those skilled in the art without departing from the spirit and scope of the invention.

Accordingly, reference should be made to the following claims in determining the full scope of the invention.

I claim:

1. A method for adjusting a manhole height comprising the steps of:

positioning a tubular shaped frame underground;

placing a removable height adjusting member on the tubular shaped frame and mounting a cover receiving frame thereon;

positioning a base frame on a base plate placed on a road surface around a periphery of said manhole while said base plate pressing the road surface with a reaction force;

arranging a pushing member between the base frame and a road surface;

connecting the base frame and the cover receiving frame by a drawing pole;

lifting the cover receiving frame via the drawing pole by means of the pushing member pushing the base frame up;

forming a space underneath the cover receiving frame and;

removing the height adjusting member located under the cover receiving frame or adding the height adjusting member under the cover receiving frame.

2. A method for adjusting a manhole height comprising the steps of:

positioning a tubular shaped frame underground;

placing a removable height adjusting member on the tubular shaped frame and mounting a cover receiving frame thereon;

positioning a support in a space at an upper section of the manhole;

positioning said support on a base plate placed on a road surface around a periphery of said manhole while said base plate pressing the road surface with a reaction force;

setting an ascending base on a supporting base, said ascending base rises relative to the supporting base;

connecting the ascending base and the cover receiving frame by a connecting pole;

lifting the cover receiving frame via the connecting pole as the ascending base rises;

forming a gap underneath the cover receiving frame;

and removing the height adjusting member placed under the cover receiving frame or adding the height adjusting member under the cover receiving frame.

3. A method for adjusting a manhole height comprising the steps of:

positioning a tubular shaped frame underground;

placing a removable height adjusting member on the tubular shaped frame; and mounting a cover receiving frame thereon;

positioning a supporting base in a space at an upper section of the manhole;

positioning said supporting base on a base plate placed on a road surface around a periphery of said manhole while said base plate pressing the road surface with a reaction force;

setting a press fitting base on a supporting base, said press fitting base lifts relative to the supporting base;

connecting the ascending base and the cover receiving frame by a connecting pole;

lowering the cover receiving frame already lifted via the connecting pole as the press fitting base is lowered;

and closing a gap underneath the cover receiving frame.

4. A system for adjusting a manhole height comprising a tubular shaped frame positioned underground;

a removable height adjusting member placed on the tubular shaped frame;

a cover receiving frame mounted thereon;

a supporting base positioned in a space at an upper section of the manhole;

a base plate placed on a road surface around a periphery of said manhole and receiving said supporting base thereon;

a base, lifting and lowering relative to the supporting base;

an ascensor installed between the supporting base and the ascending base;

and a connecting member making a connection between the ascending base and the cover receiving frame.

5. A device for adjusting a manhole height comprising a tubular shaped frame positioned underground;

a removable height adjusting member placed on the tubular shaped frame;

a cover receiving frame mounted thereon;

a supporting base positioned in a space at an upper section of the manhole;

a base plate placed on a road surface around a periphery of said manhole and receiving said supporting base thereon;

a press fitting base lifting and lowering relative to the supporting base;

an ascensor installed between the supporting base and the press fitting base and;

a connecting member making a connection between the ascending base and the cover receiving frame.

* * * * *